US005514018A

United States Patent [19]

Hara

[11] Patent Number: 5,514,018

[45] Date of Patent: May 7, 1996

[54] CROSS-BAR SUPPORT SYSTEM FOR SNOWBOARDS

[76] Inventor: Yutaka Hara, 3807 W. 190th St., Torrance, Calif. 90504

[21] Appl. No.: 394,428

[22] Filed: Feb. 24, 1995

[51] Int. Cl.[6] ..... A63C 15/00

[52] U.S. Cl. ..... 441/65; 280/14.2

[58] Field of Search ..... 114/357; 441/65–74; 280/601, 602, 608, 609, 14.2

[56] References Cited

U.S. PATENT DOCUMENTS

| | | | |
|---|---|---|---|
| 3,409,920 | 11/1968 | Brownley | 441/74 |
| 3,414,919 | 12/1968 | Gust | 441/74 |
| 3,988,794 | 11/1976 | Tinkler et al. | 441/74 |
| 4,209,867 | 7/1980 | Abrams | 441/74 |
| 4,556,237 | 12/1985 | Meatto et al. | 280/610 |
| 4,929,207 | 5/1990 | Piatt | 441/74 |
| 5,018,760 | 5/1991 | Remondet | 441/65 |
| 5,114,370 | 5/1992 | Moran | 441/65 |

*Primary Examiner*—Stephen Avila
*Attorney, Agent, or Firm*—Baker, Maxham, et al.

[57] ABSTRACT

A support frame which provides controlled stability of a snowboard while allowing the user a greater amount of foot control. The support frame is embedded within the body of the snowboard. The support frame is essentially a figure-eight shaped structure. Generally at the center of the support frame, the cross members are secured to one another. The present invention provides a substantial advantage over the prior art in dampening vibrations which occur during use of the snowboard in conventional snowboarding conditions. The support frame may also be used in a wide variety of other sporting equipment.

12 Claims, 7 Drawing Sheets

CROSS-BAR SUPPORT SYSTEM FOR SNOWBOARDS

BACKGROUND OF THE INVENTION

1. Field of the Invention

This invention relates to internal support frames, and more particularly to internal support frames within snowboards.

2. Description of Related Art

Snowboards are a recreational device. Snowboards provide a platform on which a person places both feet. Typically, a person would use a snowboard to slide down a hill, such as a conventional ski slope, in a fashion which is similar to surfing ocean waves on a surfboard. Each foot of the user is typically placed into a snowboard boot. The snowboard boot is held in place by a binding mounted on the snowboard. By a shifting of the user's weight, the snowboard can be controlled to turn to the right or left. Metallic edges, similar to the edges of conventional skis, provide added control.

One of the problems faced by the manufacturers of snowboards is making a snowboard that is flexible enough to allow the user to maintain good control at relatively slow speed. However, a snowboard must also remain stable at relatively high speeds over rough terrain, such as might be encountered on a conventional ski slope. Vibrations at the nose and tail of the snowboard can make it difficult to control the snowboard by reducing the contact between the snowboard and the terrain. In addition, a snowboard must be very durable. In particular, the edges which are primarily responsible for controlling the direction of the snowboard, make intermittent contact with the terrain. A number of techniques have been taught to provide appropriate flexibility, durability, and stability in manufacturing skis. For example, U.S. Pat. No. 4,556,237, issued to Meatto, et al. discloses selectively reinforcing an alpine ski. FIG. 1 is an illustration of the Meatto reinforcement system. In Meatto, a ski is reinforced with high strength fiber reinforcing rods 24 positioned generally horizontally within the ski's cross-section. The rods are discontinuous in the area of a binding plate 16. The rods 24 extend from near a shovel end 13 of the binding plate 16 to a shovel contact point 32 at one end of the ski, and from near a tail end 17 of the binding plate 16 to a tail contact point 34 at the other end of the ski. These contact points 32, 34 are the lines of contact of the ski where the shovel and tail of the ski under the force of only its own weight touch a flat surface. The rods 24 increase the overall resistance to flexural deformation of the structure of the ski 10 by selectively increasing the flexural or bending strength when compared to a cross-sectional beam of equivalent stiffness without such reinforcing rods 24.

However, snowboards differ from skis in that the both feet are placed on a snowboard, whereas only one foot is placed on a skis. Accordingly, the forces applied to snowboards differ from the forces applied to skis. For example, the user of a snowboard may, with a rear foot, apply a torque in one direction to the rear portion of the snowboard while applying a torque to a front of the snowboard in the opposite direction with the front foot. Clearly, the fact that two feet independently control the snowboard is an advantage. Therefore, it would be advantageous to design a snowboard such that the snowboard responds most favorably to the forces applied by each foot without sacrificing stability.

Prior art reinforcement systems in the context of skis, such as taught by Meatto, provide additional structural reinforcement to aid in dampening vibrations. But such reinforcing rods do not provide additional controlled resistance to torques exerted by twisting forces such are those encountered in the context of a snowboard in which two feet are used to control the snowboard. Since snowboards are subject to such torques, there is a need for a support structure that is capable of dampening vibrations of the front and rear of the snowboard, adding structural integrity to the snowboard against structural failures due to torques applied from the front to the rear, and to allow the front and the rear of the snowboard to be twisted about the central longitudinal axis in a controlled manner to allow maximum control of the snowboard during use.

SUMMARY OF THE INVENTION

The present invention is a support frame which provides controlled stability of a snowboard while allowing the user a greater amount of foot control. In the preferred embodiment of the present invention, the support frame is embedded within the body of the snowboard. The support frame is preferably essentially a figure-eight shaped structure. Generally at the center of the support frame (i.e., at the cross-over point in the figure-eight structure) the cross members are secured to one another. This structure allows each loop-shaped section of the figure-eight frame to move relatively freely about two axes of rotation through the single point of connection. The present invention provides the user a greater amount of control over the motion of the front of the snowboard independent from the rear of the snowboard. Likewise, greater control is provided over the rear of the snowboard independent of the front of the snowboard.

Furthermore, the present invention provides a substantial advantage over the prior art in dampening vibrations which occur during use of the snowboard in conventional snowboarding conditions. That is, the present invention stabilizes a snowboard which might otherwise vibrate near the shovel or tail as the snowboard glides over rough and uneven snow-covered terrain. Such vibrations make it more difficult for the user to control the snowboard.

The present inventive support frame may also be used in a wide variety of other sporting equipment. For example, the present invention may be used to provide improved stability and control in a variety of sport boards, such as water skis, including slalom water skis, snow skis, sailboards, boogie boards for riding ocean waves, surfboards, skateboards, or any other generally flat device that is intended to skim over a slick or liquid surface or to roll on wheels. Accordingly, the term "sport boards" as used herein should not be limited to "boards", but to any generally flat sporting equipment on which a person stands with at least one foot and which equipment moves with respect to a surface under the equipment.

The details of the preferred embodiment of the present invention are set forth in the accompanying drawings and the description below. Once the details of the invention are known, numerous additional innovations and changes will become obvious to one skilled in the art.

BRIEF DESCRIPTION OF THE DRAWINGS

Like reference numbers and designations in the various drawings refer to like elements.

DETAILED DESCRIPTION OF THE INVENTION

Throughout this description, the preferred embodiment and examples shown should be considered as exemplars, rather than as limitations on the present invention.

Figure 1:
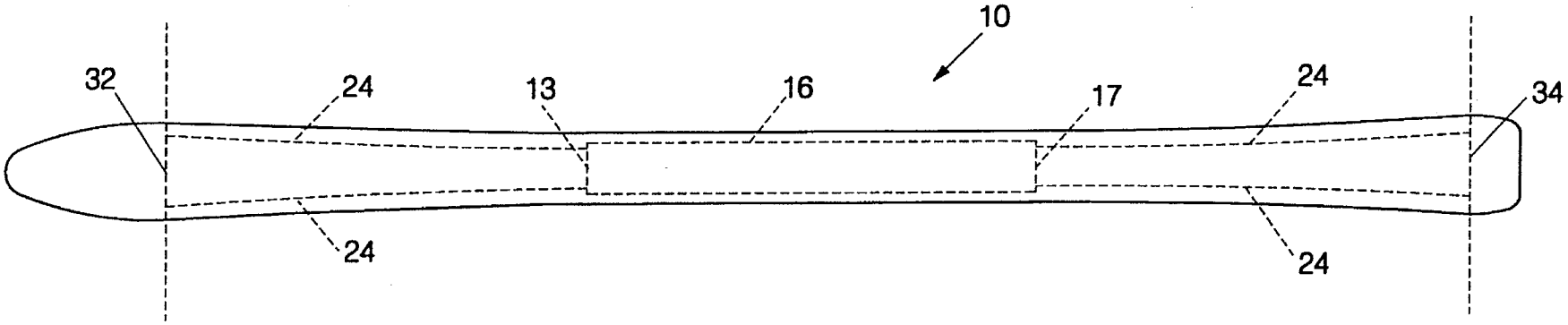
FIG. 1 PRIOR ART
FIG. 1 is an illustration of a prior art ski.
Figure 2:
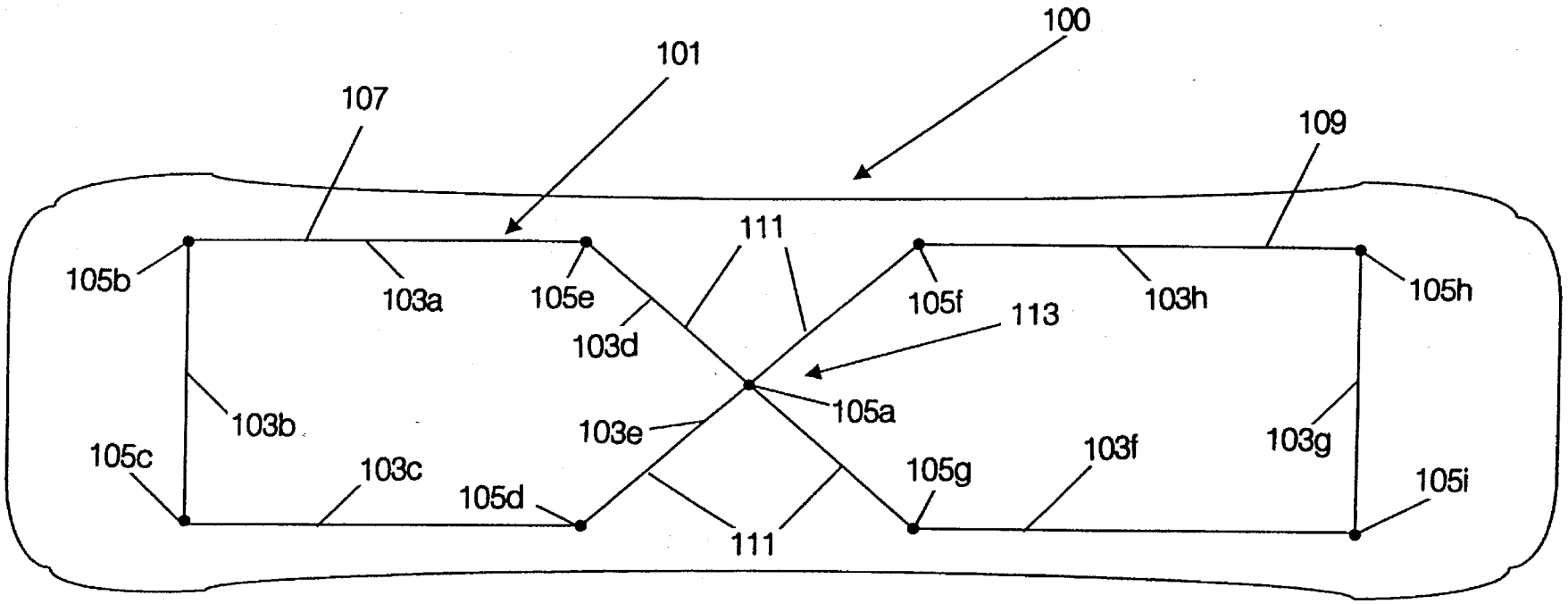
FIG. 2 is a top cross-sectional view of a snowboard including the inventive support system
Figure 3:
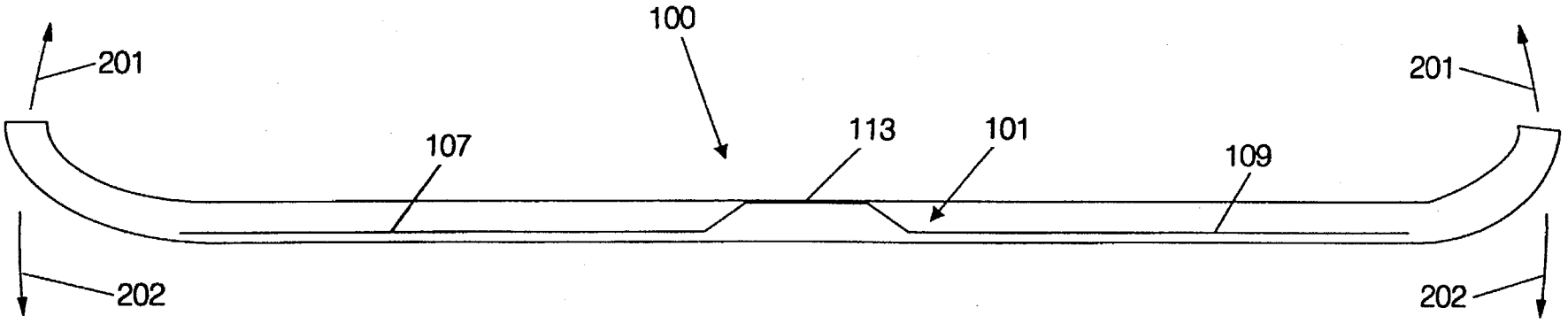
FIG. 3 is a side cross-sectional view of a snowboard including the inventive support system

FIG. 2 is a top cross-sectional view of a snowboard 100 including the inventive cross-bar support system. FIG. 3 is a cross-sectional side view of the embodiment of the present invention shown in FIG. 2. The snowboard 100 is shown in cross-section in FIGS. 2 and 3 in order to expose the cross-bar support structure 101. The cross-bar structure is preferably embedded within the body of the snowboard. In the embodiment of the present invention shown in FIGS. 2 and 3, the cross-bar structure is preferably fabricated from epoxy triaxial braided sock carbon fiber rods. Alteratively, the cross-bar may be fabricated from Kevlar rods or any other material that has sufficient shearing strength while allowing the rod to bow. The firmness of the particular material used may be rated in any reasonable manner. Such rating may be marked upon the finished snowboard. For example, a snowboard with a relatively stiff cross-bar may be marked with either a number (i.e., "9") to indicate a firm flex. Alteratively, a snowboard with a relatively flexible cross-bar may be marked with a number (i.e., "5") to indicate a soft flex. In another altemative embodiment, the snowboard may be marked with words that reveal the relative rigidity or flexibility of the board.

In one embodiment of the present invention, the cross-bar assembly is fabricated from eight essentially straight sections 103 of fiber rod. Nine points of connection **105*a*–105*i* between these eight sections 103*a*–103*h* are shown. Each section 103 can be secured to the adjacent section 103 by any conventional means, such as welding, fusing, gluing, for example with epoxy glue, or connection by means of crimped connectors in which one end of a section is flared to form a receiving cup to receive an end of an adjacent section. The central connection point 105*a* is particularly significant. This connection point 105*a* serves as the central point about which the snowboard will twist when a torque is applied to twist the snowboard about the central longitudinal axes of the snowboard. The central connection point 105*a* also provides a point about which the snowboard can flex up and down, as shown by arrows 201,202. Accordingly, there are two axis of relative freedom that the front and rear of the snowboard can rotate about. That is, by providing a single point of contact between a forward loop-shaped section 107 of the cross-bar support structure 101 and a rear section 109 of the cross-bar support structure 101, the cross-bar support structure 101** provides an improved ability to twist about the central longitudinal axis and improved ability for the forward and rear sections to independently flex up and down.

Figure 4:
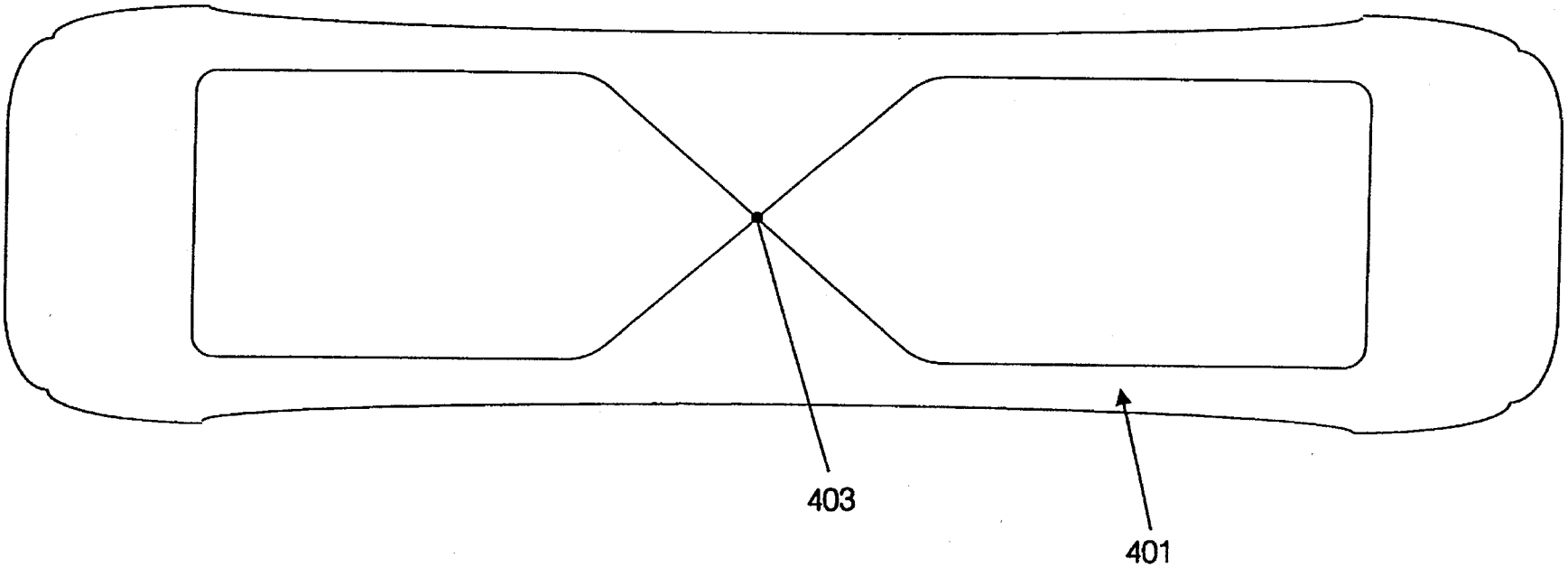
FIG. 4 is a top cross-sectional view of a snowboard including a first alternative embodiment of the inventive support system.

In another embodiment of the present invention shown in FIG. 4, a support frame 401 is fabricated from a single shaped rod. A connection is made between two points on the rod which intersect at the center point 403 to provide the proper support. The support frames of FIGS. 2–4 are essentially identical in function. It will be understood by those of ordinary skill in the art that the support frame may be fabricated in any number of other ways. For example, the support frame could be constructed from any number of sections which are then assembled together. Still further, different portions of the support frame may be fabricated from different materials or different thicknesses to provide more selective control over the flexibility and rigidity of the frame. For example, central cross-members 111 may be fabricated from material which has greater flexibility to allow the snowboard to twist more easily, while remaining portions of the support frame may be fabricated from a more rigid material to provide structural support and prevent the forward and rear portions of the snowboard from vibrating.

Figure 5:
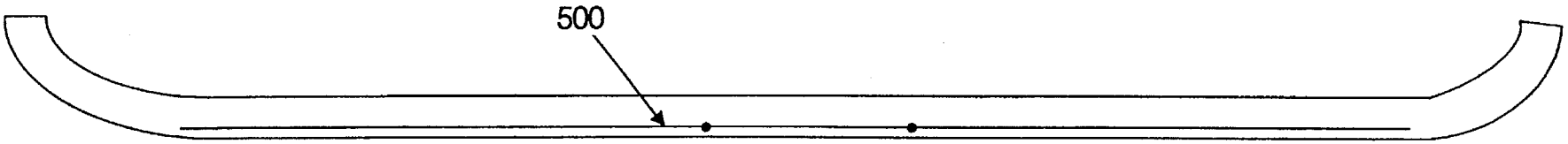
FIG. 5 is a side cross-sectional view of a snowboard including a second alternative embodiment of the inventive support system.

As shown in FIG. 3, the forward loop-shaped section 107 and rear section 109 of the support frame are coincident with a first plane. The central cross-member section 113 of the support frame (which includes each of the central cross-members 111 ) rises up from a first plane to a second plane. FIG. 5 is a side cross-sectional view of a snowboard in accordance with an altemative embodiment of the present invention. As shown in FIG. 5, the entire support frame 500 is essentially coplanar.

Figure 6:
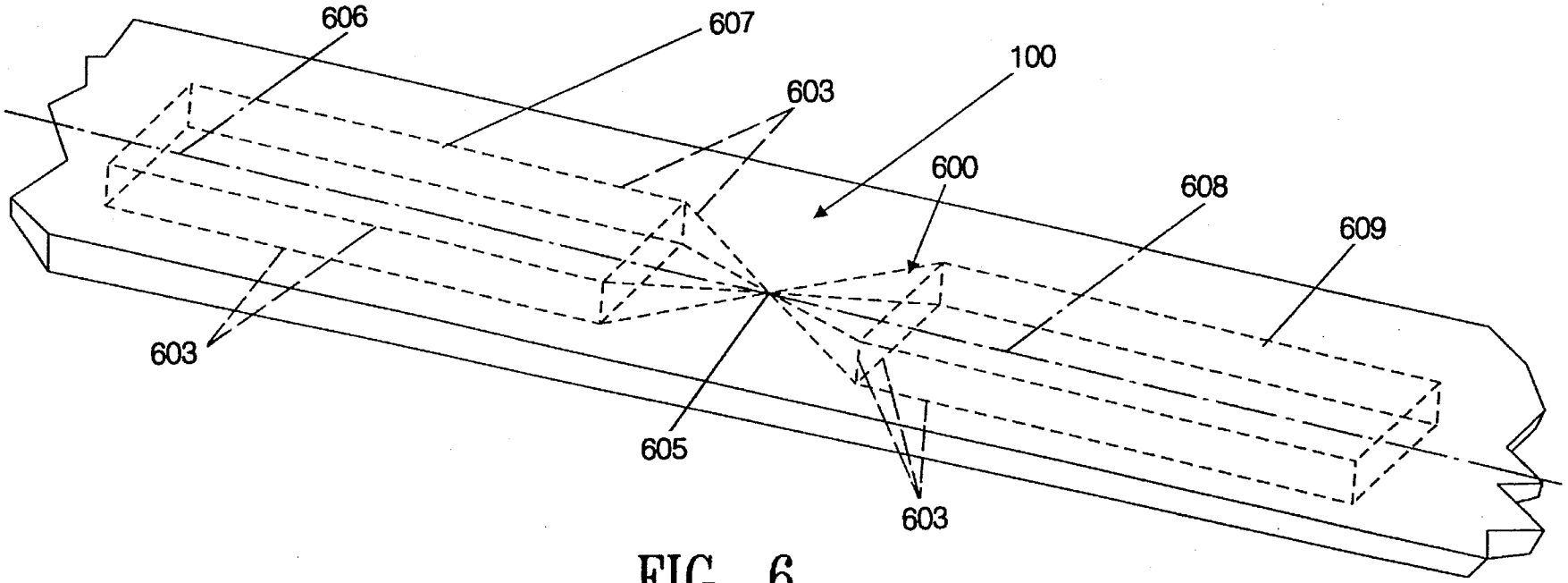
FIG. 6 is a partial perspective view of a sport board having a third altemative support frame.

FIG. 6 is yet another altemative embodiment of the present invention. As shown in FIG. 6, the forward cage 607 and rear cage 609 of a support frame 600 are constructed of rods 603 (represented by dashed lines) to provide additional support. In one embodiment of the invention shown in FIG. 6, the cages 607, 609 may be filled with a material that is more or less flexible than the material which surrounds the cages 607, 609. In another embodiment of the invention shown in FIG. 6, the cages are embedded within the snowboard. Accordingly, the cages 607, 609 are filled with the same material that generally surrounds the cages 607, 609.

Figure 7:
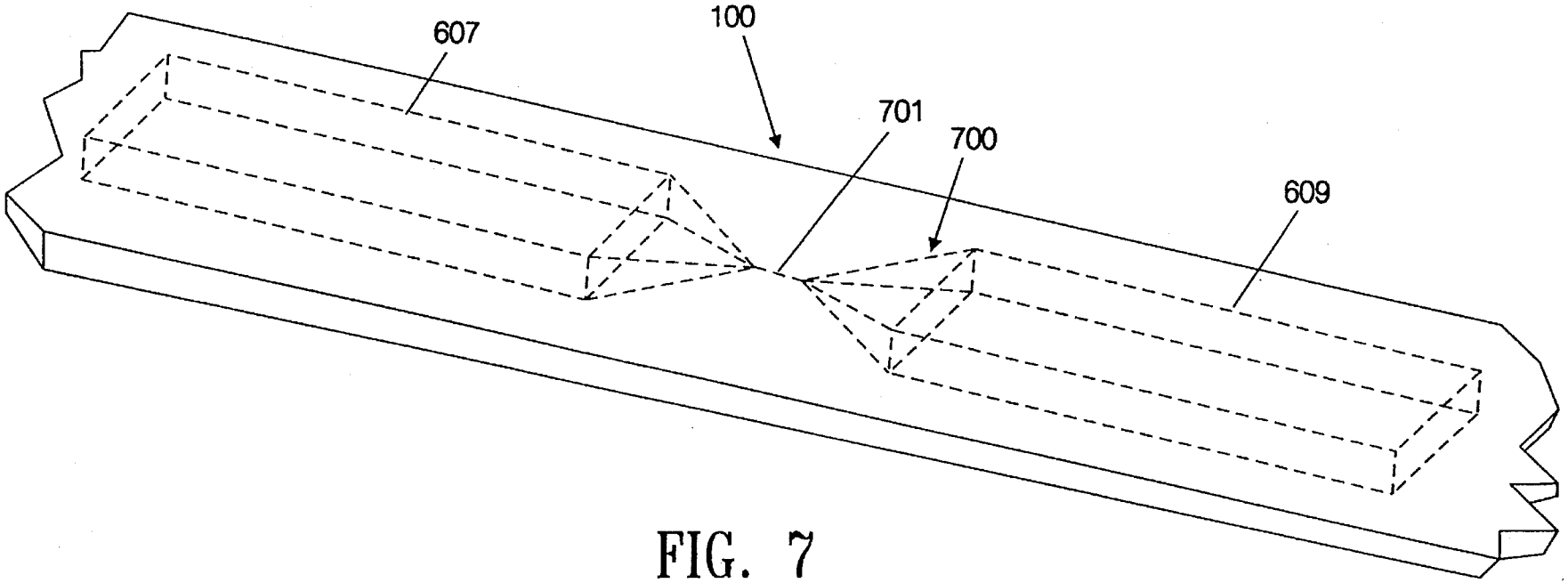
FIG. 7 is a partial perspective view of a sport board having a fourth alternative support frame.

The forward cage 607 and the rear cage 609 are connected at a single point 605. Accordingly, the forward cage 607 and the rear cage 609 have relative freedom to rotate about two axes of rotation 606, 608 through the point 603. FIG. 7 illustrates an altemative embodiment of the present invention in which a connection rod 701 connects the forward cage 607 to the rear cage 609. This embodiment also allows the forward cage and rear cage to rotate about the longitudinal axis of the connection rod 701 (i.e., the forward section 607 can twist with respect to the rear section 609). The snowboard 100 in which this support frame 700 is mounted is also relatively free to bend at the center due to there being less support along the connection rod 701 than along each cage.

A number of embodiments of the present invention have been described. Nevertheless, it will be understood that various modifications may be made without departing from the spirit and scope of the invention. For example, the particular material used to fabricate the support frame is to be selected to be appropriate to the amount of flexibility or rigidity desired. Also, while the inventive support structure is primarily described in the context of a snowboard, the present invention may be used in other sport boards, such as surfboards, skateboards, sailboards, boogie boards, water skis, and snow skis. Accordingly, it is to be understood that the invention is not to be limited by the specific illustrated embodiment, but only by the scope of the appended claims.

We claim:

1. A sport boards, including:

(a) a body;

(b) a forward rigid support section embedded within the body;

(c) a rear rigid support section embedded within the body; and (d) a single point of connection which coupled the forward support section to the rear support section, such that the forward support section and rear support section are relatively free to rotate about at least two axes of rotation through the point of connection.

2. The support frame of claim 1, wherein the forward section and the rear section are generally loop-shaped.

3. The support frame of claim 1, wherein the support frame is fabricated from a plurality of rods, each rod coupled to at least one other adjacent rod.

4. The support frame of claim 1, wherein the rods are fabricated from carbon fiber.

5. The support frame of claim 1, wherein the support frame is fabricated from a single shaped rod.

6. The support frame of claim 4, wherein the support frame is fabricated from Kevlar carbon fiber.

7. A sport board, including:

(a) a body:

(b) forward rigid support cage section within the body;

(c) a rear rigid support cage section within the body;

(d) a single point of connection which couples the forward support cage section and the rear support cage section, such that the forward support cage section and rear support cage section are relatively free to rotate about at least two axes of rotation through the point of connection.

8. The support frame of claim 6, wherein the support frame is fabricated from a plurality of rods, each rod coupled to at least one other adjacent rod.

9. The support frame of claim 7, wherein the rods are fabricated from carbon fiber.

10. A sport board, including:

(a) a body;

(b) a forward rigid support cage section;

(c) a rear rigid support cage section;

(d) a single point of connection which couples the forward support cage section and the rear support cage section, such that the forward support cage section and the rear support cage section are relatively free to rotate about two axes of rotation through at least one point which lies on the line of connection.

11. The support frame of claim 9, wherein the support frame is fabricated from a plurality of rods, each rod coupled to at least one other adjacent rod.

12. The support frame of claim 10, wherein the rods are fabricated from carbon fiber.

* * * * *